US006591825B1

(12) United States Patent
Huddleston

(10) Patent No.: US 6,591,825 B1
(45) Date of Patent: Jul. 15, 2003

(54) SLING ASSEMBLY FOR CARRYING AND STABILIZING A CROSSBOW

(76) Inventor: Jerry Huddleston, 1685 Victor Ave., Ypsilanti, MI (US) 48198

( * ) Notice: Subject to any disclaimer, the term of this patent is extended or adjusted under 35 U.S.C. 154(b) by 0 days.

(21) Appl. No.: 10/113,767

(22) Filed: Apr. 1, 2002

(51) Int. Cl.[7] ..... F41B 5/14

(52) U.S. Cl. ..... 124/86; 124/25; 224/257; 224/916

(58) Field of Search ..... 124/25, 86; 224/257, 224/264, 271, 576, 916

(56) References Cited

U.S. PATENT DOCUMENTS

| | | | | | |
|---|---|---|---|---|---|
| 4,480,774 | A | * | 11/1984 | Smith et al. | |
| 4,768,689 | A | | 9/1988 | Davis | 224/257 |
| 5,205,268 | A | | 4/1993 | Savage | 124/24.1 |
| 5,351,867 | A | | 10/1994 | Vest | 224/224 |
| 5,497,512 | A | | 3/1996 | Wright | 2/102 |
| 5,509,400 | A | | 4/1996 | Chalin | 124/86 |
| 5,522,376 | A | * | 6/1996 | Collinsworth | 124/86 |
| 5,730,341 | A | * | 3/1998 | Hester, Jr. | |
| 5,890,478 | A | | 4/1999 | Dunmore | 124/86 |
| 5,911,216 | A | * | 6/1999 | Killian | 124/86 |
| 6,059,240 | A | | 5/2000 | Gorsuch | 248/219.4 |
| 6,155,470 | A | * | 12/2000 | Robison | |
| 6,173,707 | B1 | | 1/2001 | Howell et al. | 124/88 |
| 6,202,236 | B1 | | 3/2001 | Price | 5/657 |
| 6,269,577 | B1 | | 8/2001 | Hardy | 42/90 |
| 6,279,795 | B1 | | 8/2001 | Pierzina | 224/150 |

* cited by examiner

*Primary Examiner*—John A. Ricci
(74) *Attorney, Agent, or Firm*—Gifford, Krass, Groh, Sprinkle, Anderson & Citkowski, PC

(57) ABSTRACT

An over-the-shoulder sling at least partially supports the weight of a crossbow without interfering with use. The apparatus includes a shaped bracket attachable to the front of the bow, such as to the foot stirrup used when pulling back the string. A sling assembly including an over-the-shoulder section connects to the shaped bracket. A length of the sling assembly from where it attaches to the bracket is preferably at least semi-rigid to ensure that no portion of the sling interferes with the bowstring or bolt (arrow) during use. The semi-rigid section preferably attaches to the curved bracket through a rotating and pivoting connection providing multiple degrees of freedom.

5 Claims, 2 Drawing Sheets

SLING ASSEMBLY FOR CARRYING AND STABILIZING A CROSSBOW

FIELD OF THE INVENTION

This invention relates generally to bowhunting and, in particular, to an article for assisting a hunter in carrying and stabilizing a crossbow.

BACKGROUND OF THE INVENTION

Crossbows have become increasingly popular among bowhunters, particularly more seasoned or handicapped hunters, since crossbows are more convenient than vertical bows, which must be drawn at the time of a shoot. Since crossbows can be pulled back in advance, it is easier for some hunters to obtain a more accurate shot during release.

Unfortunately, some crossbows can be quite heavy, weighing several pounds or more, which can lead to fatigue, particularly while standing or stalking. There is an outstanding need, therefore, for an article to assist a hunter in carrying and/or stabilizing a crossbow during a hunt.

SUMMARY OF THE INVENTION

This invention assists an archer in using a crossbow by providing an over-the-shoulder sling assembly which at least partially supports the weight of the bow without interfering with use. The preferred embodiment includes a shaped bracket attachable to the front of the bow, such as to the foot stirrup used when pulling back the string. A sling assembly which may include a padded section connects to the shaped bracket. A length of the sling assembly from where it attaches to the bracket is preferably at least semi-rigid to ensure that no portion of the sling assembly interferes with the bowstring or bolt (arrow) during use. The semi-rigid section preferably attaches to the curved bracket through a rotating and pivoting connection providing multiple degrees of freedom.

DETAILED DESCRIPTION OF THE INVENTION

Figure 1:
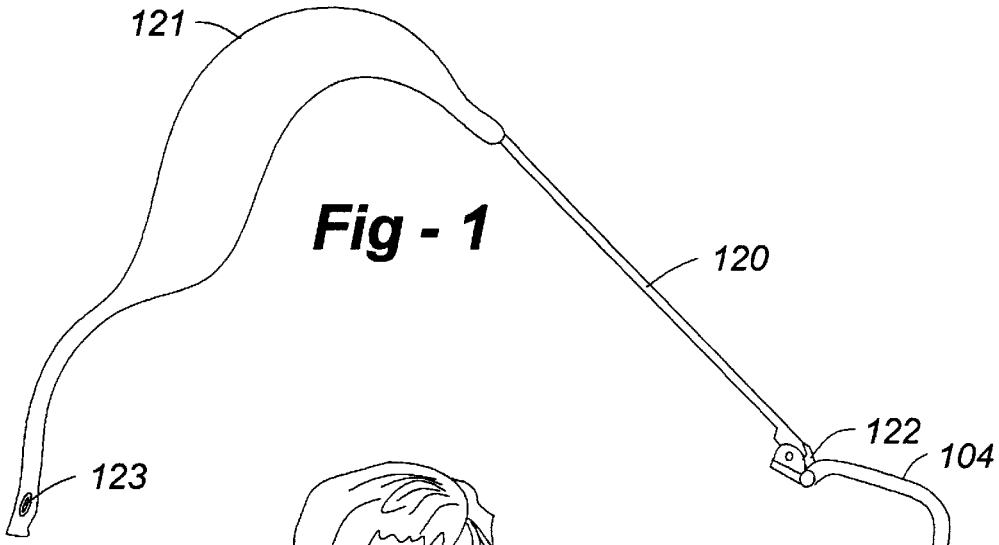
FIG. 1 is a drawing showing the preferred embodiment of the invention.
Figure 2:
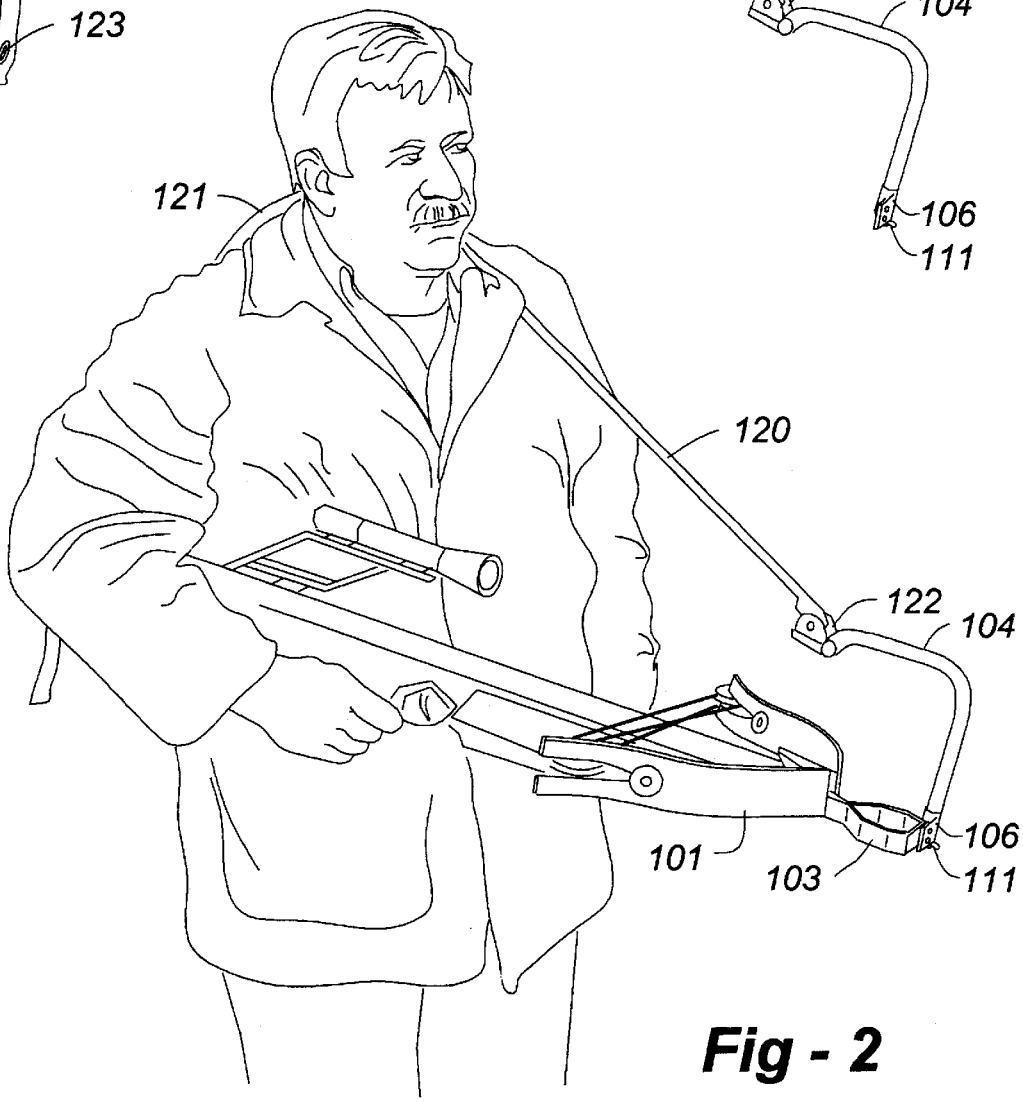
FIG. 2 shows the preferred embodiment of the invention mounted on a crossbow being held by a user.
Figure 3:
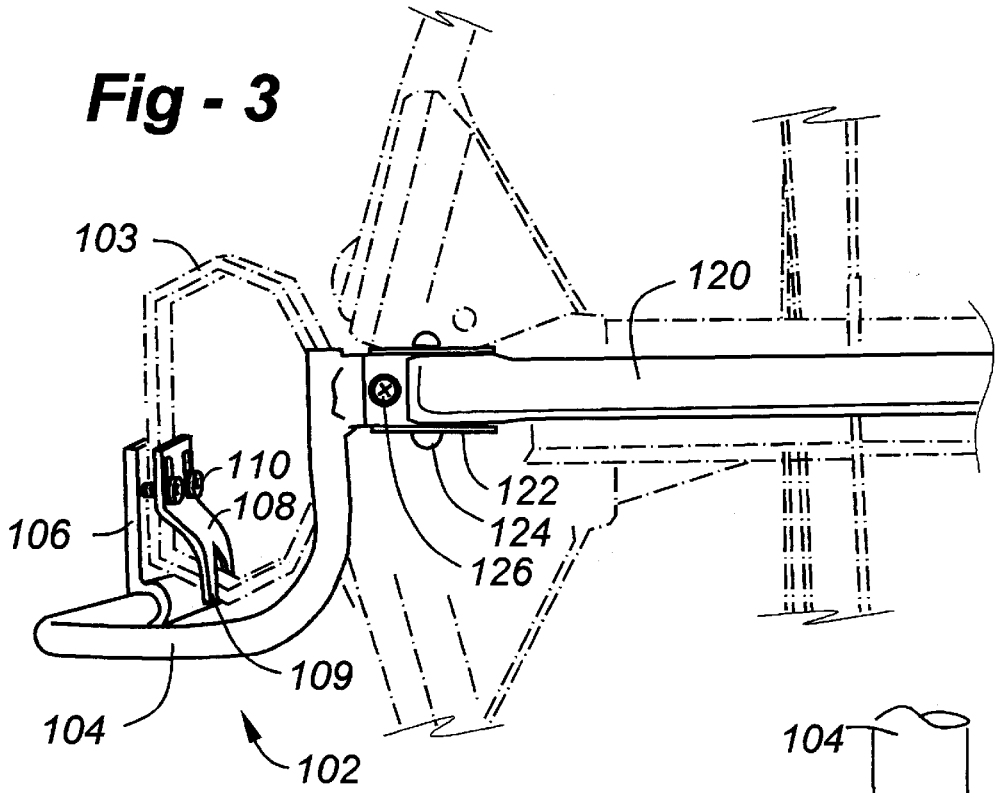
FIG. 3 is a close up, detailed drawing showing the preferred way in which the invention may be mounted to the stirrup provided on many crossbows.

FIG. 1 is a drawing which shows a preferred embodiment of the invention, and FIG. 2 shows the preferred embodiment mounted to a crossbow held by a user. In FIG. 3, the bow itself is shown in broken-line form, since, in the preferred embodiment, the invention is universally mountable to different styles of crossbows, perhaps through different attachment mechanisms described herein.

Broadly, the invention provides a strap or sling which, during use in carrying or stabilizing the crossbow, is positioned over one of the user's shoulders. Although FIG. 2 shows the sling portion being dressed over the shoulder opposite to that under which the crossbow is being carried, either shoulder may be used, depending upon user preference.

The sling portion attaches at one end to a forward portion of the bow, with the other end being connected to the back end of the bow, typically at the butt-end of the stock (not shown). As will be described in further detail below, the sling portion includes a rigid or semi-rigid member 120, which may include a padded section 121, terminating in a rearward stock attachment such as mechanism 123, three-bar adjuster, etc. Again, however, the invention is not limited in terms of specific attachment device(s). For example, the sling portion may include one or more stretchable portions to help hold the bow to the shoulder when shooting, such as the case where the shooter had a single functioning arm to hold the crossbow to his/her shoulder.

In the preferred embodiment, the front end of the sling portion attaches to the forward end of the bow through a bracket in the form of a curved element 104 having one end mounted through plate 106 to the bow itself, and another end including pivot plate 122 terminating at a point above the bow, to provide optimal weight distribution without interfering with sighting or shooting. As such, the point to which the forward end of the sling attaches at a point which is weight-balanced from side-to-side, preferably directly above the bolt in a loaded, ready position. That is, using the bent element 104, the bracket may be mounted at a point off center while achieving a connection at a central or weight-balanced position.

FIG. 3 is a detail drawing which illustrates the preferred way in which the invention is mounted to a stirrup-type of foot engagement feature found on many popular crossbows. However, the invention is not limited in this regard, in the sense that different clamps may be provided to accommodate different features on different crossbows, including T-shaped foot engagement features. In addition, in some cases, the stirrup or foot-engagement feature may be removed if so fastened, with the invention being mountable directly to the bow using, for example, a bolt-receiving aperture. As a further option, some bows are provided with slots, grooves, or other features, any of which are usable by the invention for mounting purposes. As yet a different configuration, the invention may be mounted to the bow's sight pin bracket, if so provided.

The bracket 102 preferably connects to one corner of the stirrup 103 through a forward plate 106, and an opposing rearward plate 108. These plates are held together in clamping fashion on the forwardmost or lowermost portion of the stirrup 103 through threaded fasteners 110, so as to provide a secure and rigid connection. In addition, note that the plate 108 includes a pair of tines 109, one of which is positioned on either side of the side portion of the stirrup 103, thereby further preventing a twisting motion of the assembly once installed.

Figure 5:
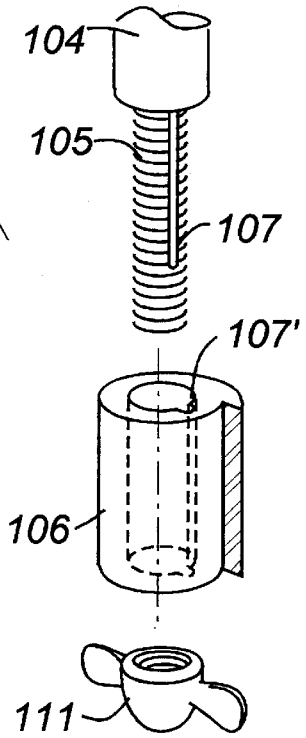
FIG. 5 is a close up, detailed drawing showing the way in which the curved bracket is removeably secured in a manner that prevents twisting.

As a further desirable option, the shaped portion 104 is preferably removable from the plates by loosening a fastener 111. This allows the shaped portion 104 and sling assembly attached thereto to be at least temporarily removed for storage, transport, or other periods of non-use. A preferred configuration is depicted in FIG. 5. The shaped portion 104 includes a threaded end 105 which fits into the forward plate 106 and is held in place using a manual fastener such as wingnut 111. To prevent rotation, the threaded shaft includes a feature 107 that fits into a keyway 107'. It will be apparent to those of skill that other anti-rotation arrangements may be used, including eccentric couplings, "flats," and so forth.

Figure 4:
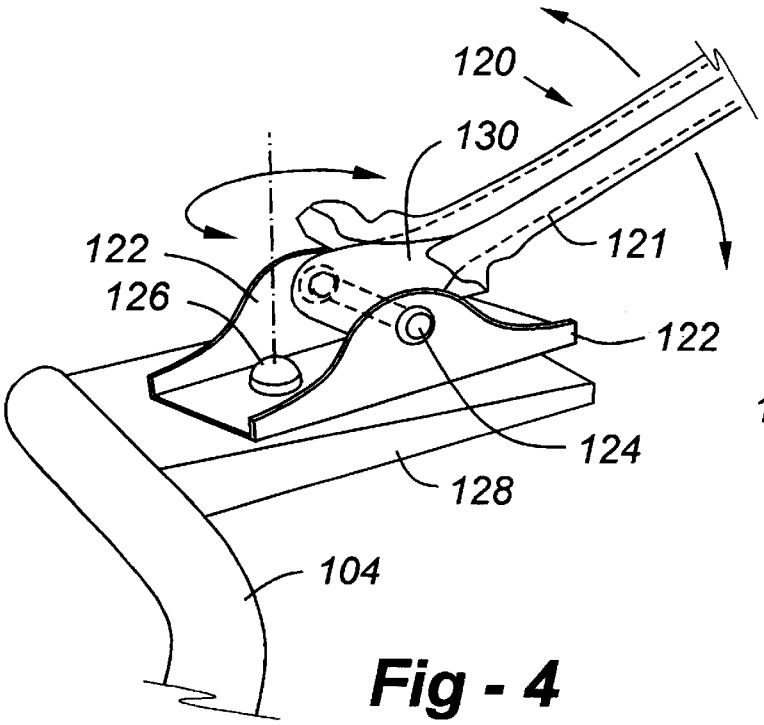
FIG. 4 is a close up, detailed drawing showing the way in which an elongated member is preferably rotatably and pivotally attached to a mounting bracket so as to provide multiple degrees of freedom.

FIG. 4 is a detail drawing which shows the way in which the elongated member 120 attaches to the bracket 102 at a point weight-balanced or directly above the bolt guide. Since it is desirable to mount the bracket 102 on the side of the stirrup 103 so that a foot can still be used for cocking the bow, the bracket 102 is preferably curved in an up-and-over fashion, as shown, placing plate 128 in a weight-balanced position, preferably directly above the bolt in a loaded position.

Although the elongated member 120 incorporates the use of a material or covering, in the preferred embodiment, a stiffening member 121 is preferably used to ensure that the elongated member does not fall into the path of the bowstring or bolt, enabling a shot to occur unimpeded with the invention being mounted on the bow. As an alternative to a stiffening member 121 within a sheath 120, one or more "flexibly rigid" elements may be used, and any appropriate material may be used in any case, such as aluminum, fiberglas, graphite, plastic or other polymeric material, and so forth.

Since the elongated member 120 is preferably rigid or stiffened, it is also desired in the preferred embodiment to employ a pivoting connection where the member 120 attaches to the bracket. As shown in FIG. 4, this is accomplished through the use of a two-way pivoting joint, including a hinge allowing pivoting up and down, with the hinge being mounted on a bracket 122 having a pin 126 allowing movement from side-to-side. The combination of the up/down and side/side movements thereby providing effectively a ball joint type of connection. It will be appreciated that other forms of rotatable or pivoting connectors may alternately be used in the preferred embodiment, including ball-and-socket joints, a length of flexible material such as rubber, braided fiber, leather, and so forth.

Note that, with the pivoting joint being positioned at a point above the bow as shown, and with the length of the rigid or stiffened member being sufficiently long, the end of the member where it attaches to the shoulder strap falls at a point which is behind the string of a loaded bow, thereby allowing a shot to be fired unimpeded, without concern that the invention will interfere with the bow string.

I claim:

1. Apparatus for transporting and stabilizing a crossbow having a forward end, a rearward end, and a bowstring defining a plane, the apparatus comprising:

a sling assembly having a first end couplable to the forward end of the crossbow and a second end couplable to the rearward end of the crossbow; and wherein a length of the sling assembly is at least semi-rigid extending from the point where it couples to the forward end of the crossbow so as to prevent interference of the sling with the bowstring during use.

2. The apparatus of claim 1, wherein the first end of the sling assembly is coupled to the forward end of the crossbow through a bracket operative to position the point of coupling above the plane of the cross bow.

3. The apparatus of claim 2, wherein the point of coupling including a pivot to allow the sling assembly to move relative to the crossbow.

4. The apparatus of claim 2, wherein:

the crossbow includes a foot stirrup at its forward end; and the bracket is configured for attachment to the stirrup.

5. The apparatus of claim 2, wherein:

the bracket includes a first portion attachable to the crossbow; and a second portion attached to the sling assembly enabling the sling assembly to be at least temporarily removed from the first portion for storage or transport purposes.

* * * * *